US006450003B1

(12) United States Patent
Pawson

(10) Patent No.: US 6,450,003 B1
(45) Date of Patent: Sep. 17, 2002

(54) TOOL AND METHOD FOR STRAIGHTENING A DOOR HINGE

(75) Inventor: Eric C Pawson, Fremont, CA (US)

(73) Assignee: Steven M. Goldstein, Fremont, CA (US)

( * ) Notice: Subject to any disclaimer, the term of this patent is extended or adjusted under 35 U.S.C. 154(b) by 0 days.

(21) Appl. No.: 09/767,655

(22) Filed: Jan. 22, 2001

(51) Int. Cl.[7] ..... B21D 7/022
(52) U.S. Cl. ..... 72/457; 29/11; 72/479
(58) Field of Search ..... 72/457, 479; 29/11

(56) References Cited

U.S. PATENT DOCUMENTS 407,851 A * 7/1889 Cheney ..... 72/457
780,756 A * 1/1905 Lakin ..... 72/458
2,732,743 A * 1/1956 Hart ..... 72/458
4,034,595 A * 7/1977 Smith ..... 72/479
4,188,701 A * 2/1980 Ludwig ..... 29/275
4,619,132 A * 10/1986 Mcbee ..... 72/458
4,641,516 A * 2/1987 Satoh ..... 72/478
5,435,030 A * 7/1995 Phillips ..... 29/275
5,875,535 A * 3/1999 Canoy ..... 72/275
5,951,818 A * 9/1999 Gaetano ..... 72/457

* cited by examiner

*Primary Examiner*—David Jones
(74) *Attorney, Agent, or Firm*—Robert Samuel Smith

(57) ABSTRACT

A tool for adjusting a door hinge so that the door hangs properly. The tool is a tube with a slot extending from one end of the tube to the other end of the tube and having a bore to permit sliding the tube over the knuckles of the door hinge. In use, the tube is slid over the knucles of the hinge with the plates of the hinge extending through the slot. The door is opened sufficiently so that the swage and/or mounting plate are adjusted to where the door swings and closes properly.

1 Claim, 3 Drawing Sheets

1. PROVIDE TOOL BEING A TUBE WITH A SLOT

2. SLIDE TOOL OVER KNUCKLES OF DOOR HINGE OF HANGING DOOR.

3. OPEN DOOR TO ADJUST SWAGE AND/OR MOUNTING PLATE

TOOL AND METHOD FOR STRAIGHTENING A DOOR HINGE

FIELD OF THE INVENTION

This invention relates to adjusting door hinges and particularly to a tool that slides onto an installed door hinge and straightens the door hinge.

BACKGROUND AND INFORMATION DISCLOSURE

The typical door hinge 11, shown in FIG. 1, includes two hinge plates 14, 18, and a hinge pin 20. Each hinge plate, 14, 18 has one or more knuckles 16 that are aligned with the one or more knuckles 16 of the other hinge plate. The hinge pin through the knuckles secures the hinge plates 11 together.

Most metal doors and door frames have hinges attached to a mounting plate which is secured to the door frame.

A cross-section of the assembled hinge 11 is shown in FIG. 2. A bend 21 in each hinge plate (called a "swage") is formed in order that, when the door is closed, the door will close properly.

However, as the door ages, and even oftentimes with new doors, the door will not close properly A number of devices have been disclosed related to the mounting of doors on door frames with hinges.

For example, U.S. Pat. No. 5,875,535 to Cannoy discloses a hinge pin removal tool comprising an elongated handle with an extension having a wedge shaped tip and pin for loosening the pin and driving the loosened pin from the knuckles of the hinge, U.S. Pat. No. 5,435,030 to Phillips discloses a tool for performing three functions. A punch mounted orthogonally near one handle is used initially to dislodge the pin from the knuckle. The other end of the handle has a wrench-like spanner configuration that is engaged with the hinge. Force is applied to the handle to straighten bends in the hinge. The magnitude of force applied by the carpenter directly against the tool to bend the hinge is a matter of the carpenter's judgement so that the adjustment is not accurate.

Such misalignment generally originates in the "swage" in the door hinge. In the context of this specification, the term "swage" ( a common term in the art of door hinges) means the offset of the axis of the knuckles of each hingeplate from the plane of the respective hinge plate that enables the two hinge plates to rotate to flush against one another.

U.S. Pat. No. 4,619,132 to Henderson et al discloses a flat bar (strap) with a bent portion on each end of the bar. Each bent portion has a notch for engaging the top or bottom flange of a hinge permitting a carpenter to apply a bending force to straighten the hinge. None of these disclosures addresses the problem of misalignment of the door hinge that can occur after the door is hung.

SUMMARY OF THE INVENTION

It is an object of this invention to provide a tool that is applied to bending or changing the swage or mounting plate of a door hinge with the edges of the door and door frame.

The tool of this invention is directed toward a tube having a straight slot extending from one open end to the other open end of the rube. In applying the tube to adjusting the swage of the hinge or mounting plate, the tube is slid onto the knuckles of the hinge. A "stop" (screw in one end of the tube position the tube on the hinge. The door is then opened sufficiently (a few inches) to adjust (bend) the swage or mounting plate.

DESCRIPTION OF PREFERRED EMBODIMENTS

Figure 1:
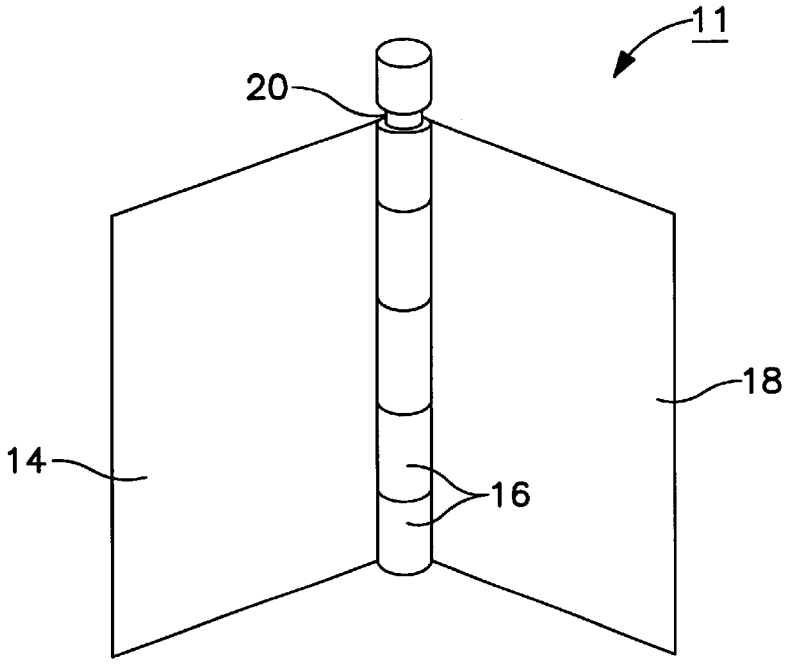
FIG. 1 shows a door hinge (prior art).
Figure 2:
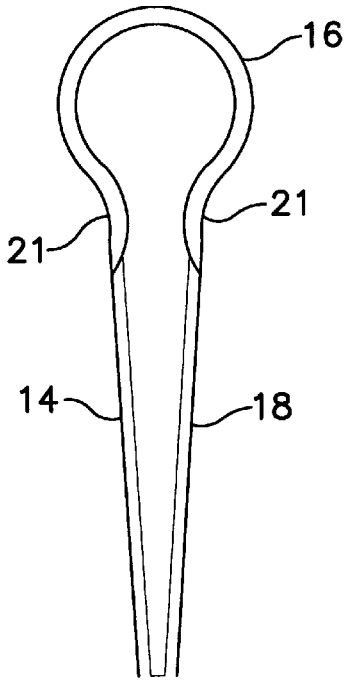
FIG. 2 is a top view of a door hinge illustrating the swage.
Figure 3:
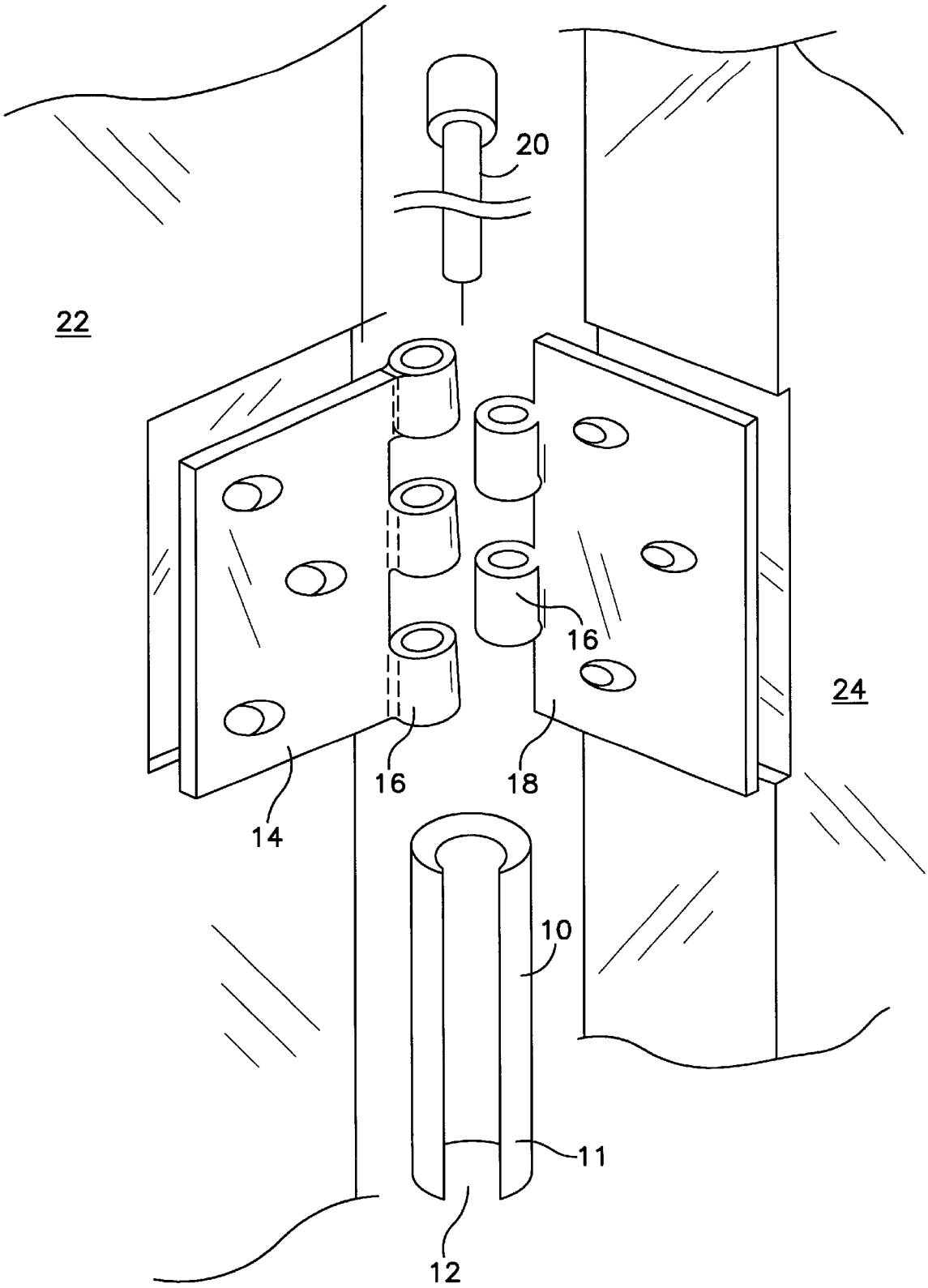
FIG. 3 is a perspective exploded view showing the tool of this invention and a door hinge.

Turning now to a discussion of the drawings, FIG. 3 is a perspective exploded view illustrating the invention. The tool is a tube 10 having an offset center with a slot 12 extending from one end to the other end of the tube 10. The door 24 and door frame 22 (cutaway ) are shown, The parts of the hinge are also shown including a first hinge plate 14 with knuckles 16 and a second hinge plate 18with knuckles 16. Hinge pin 20 slides through the knuckles 16 when the hinge is assembled. First hinge plate 14 is attached to the door frame 22 and the second hinge plate 18 is attached to the door 24.

FIG. 3 also shows that the center 11 of knuckle 16 is offset from center 13 of hinge plate 14 by a distance "s" in order that hinge plates 14 and 18 come into flush contact with one another when the hinge plates are folded together. The offset, s, is the "swage" in the context of this specification.

Figures 4, 5:
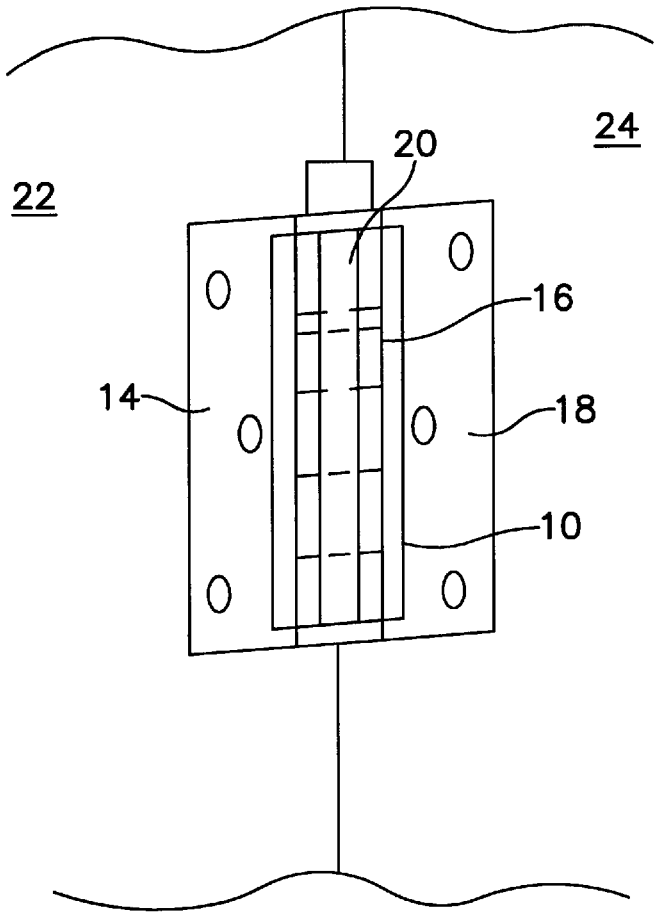
FIG. 4 is a planar view showing the tool mounted on the hinge is attached to the door.
FIG. 5 is a flow chart illustrating steps in practicing the method of this invention.

FIG. 4 is a plan view showing the tube 10 slid over the assembled hinge. The pin 20 (in phantom) extends through the knucles 16 (shown in phantom) so that the edge of the door 24 abuts door frame 22.

FIG. 5 is a flow chart listing the steps in the method of this invention for aligning the door hinge.

In step 1, the tool of FIG. 3 is provided being a tube with a slot extending from one end to the other end of the tube.

In step 2, the tube is slid over the knucles of the door hinge.

In step 3, the door is opened sufficiently to provide that the tool exerts an aligning force on the door hinge and edges of the door and door frame by bending the swage.

Variations and modifications of the invention contemplated after studying the drawings and reading the specification may be within the scope of the invention. I therefore wish to define the scope of my invention by the appended claims.

I claim:

1. A method for aligning a swage of each one of a pair of hinge plates of a door hinge with one another and with an edge of a door where one hinge plate is attached to an edge of a door and another one of said hinge plates is attached to a door frame wherein:

each hinge plate is attached to a respective set of knuckles;

each hinge plate is offset from an axis of said respective set of knuckles by said swage;

said hinge plates are hingeably secured together by a hinge pin slidably positioned through both said respective sets of knuckles;

said method including the steps:

A. providing a tool, said tool comprising a tube with a bore and a slotted opening in a side of said tube connecting with said bore and parallel thereto and extending from one end of said tube to another end of said tube wherein said bore has a diameter and location selected to permit telescoping said tube onto both said respective sets of knuckles with each hinge plate, outside said tube, secured to said respective set of knuckles through said slot;

B. telescoping said tool onto said sets of knuckles;

C. opening said door sufficiently to deform by way of said telescoping tool each swage into alignment with one another and with said edge of said door.

* * * * *